US010245483B2

(12) United States Patent
Kitagawa et al.

(10) Patent No.: US 10,245,483 B2
(45) Date of Patent: Apr. 2, 2019

(54) GOLF CLUB HEAD

(71) Applicant: BRIDGESTONE SPORTS CO., LTD., Tokyo (JP)

(72) Inventors: Tomonori Kitagawa, Tokyo (JP); Wataru Ban, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 15/896,467

(22) Filed: Feb. 14, 2018

(65) Prior Publication Data

US 2018/0264330 A1 Sep. 20, 2018

(30) Foreign Application Priority Data

Mar. 16, 2017 (JP) ..... 2017-051910

(51) Int. Cl.
*A63B 53/04* (2015.01)
*A63B 53/08* (2015.01)

(52) U.S. Cl.
CPC ..... *A63B 53/0466* (2013.01); *A63B 53/04* (2013.01); *A63B 53/08* (2013.01); *A63B 2053/045* (2013.01); *A63B 2053/0433* (2013.01); *A63B 2053/0454* (2013.01); *A63B 2053/0491* (2013.01)

(58) Field of Classification Search
CPC ..... A63B 53/04; A63B 53/0466; A63B 53/08; A63B 2053/0433; A63B 2053/045; A63B 2053/0491; A63B 2059/0003
USPC ..... 473/346, 344, 335, 334, 338, 332
See application file for complete search history.

(56) References Cited

U.S. PATENT DOCUMENTS

| | | | | |
|---|---|---|---|---|
| 7,568,985 | B2 | 8/2009 | Beach et al. | |
| 8,758,153 | B2 | 6/2014 | Sargent et al. | |
| 8,858,363 | B2 * | 10/2014 | Wada | A63B 53/0466 473/346 |
| 9,033,821 | B2 * | 5/2015 | Beach | A63B 53/02 473/334 |
| 2012/0142450 | A1 | 6/2012 | Wada et al. | |
| 2012/0322580 | A1 | 12/2012 | Wada et al. | |

FOREIGN PATENT DOCUMENTS

| | | |
|---|---|---|
| JP | 2006-095055 | 4/2006 |
| JP | 2012-120646 | 6/2012 |
| JP | 2013-000292 | 1/2013 |

* cited by examiner

*Primary Examiner* — Benjamin Layno
(74) *Attorney, Agent, or Firm* — IPUSA, PLLC

(57) ABSTRACT

A golf club head includes a face, a sole, an attachment member, an attachment part, and a rib. The face includes a ball-striking surface. The sole defines the bottom of the golf club head. The attachment member is attachable to the attachment part. The rib is formed on the internal surface of the golf club head, and at least partially surrounds the attachment part.

6 Claims, 7 Drawing Sheets

GOLF CLUB HEAD

CROSS-REFERENCE TO RELATED APPLICATION

This application is based upon and claims priority to Japanese Patent Application No. 2017-051910, filed on Mar. 16, 2017, the entire contents of which are incorporated herein by reference.

BACKGROUND OF THE INVENTION

1. Field of the Invention

The present invention generally relates to golf club heads.

2. Description of the Related Art

It has been proposed to provide the sole or the like of a golf club head with a rib. Some ribs are provided on the sole or the like to improve the impact sound of the golf club head that is produced when the golf club head strikes a ball. For example, such ribs are provided to contact a weight port for head weight adjustment. For related art, reference may be made to Japanese Laid-open Patent Publication Nos. 2012-120646, 2013-000292, and 2006-095055 and U.S. Pat. Nos. 8,758,153 and 7,568,985.

SUMMARY OF THE INVENTION

According to an aspect of the present invention, a golf club head includes a face, a sole, an attachment member, an attachment part, and a rib. The face includes a ball-striking surface. The sole defines the bottom of the golf club head. The attachment member is attachable to the attachment part. The rib is formed on the internal surface of the golf club head, and at least partially surrounds the attachment part.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE PREFERRED EMBODIMENTS

Figure 1A:
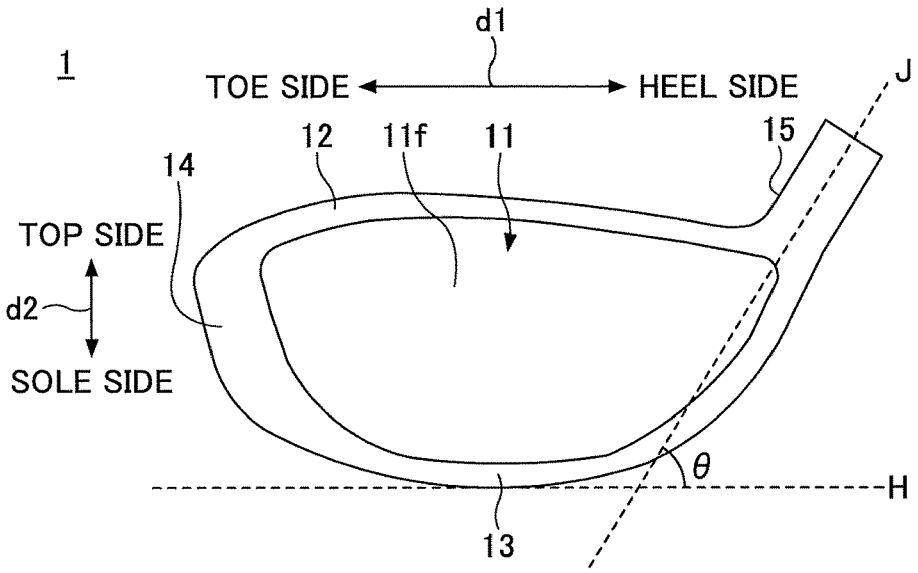
FIGS. 1A through 1D are diagrams illustrating a golf club head according to an embodiment.

One or more embodiments are described below with reference to the accompanying drawings. In the following description, the same elements or components are referred to using the same reference numeral, and a repetitive description thereof may be omitted.

FIGS. 1A through 1D are a front elevational view, a bottom (sole side) view, a left side (toe side) elevational view, and a right side (heel side) elevational view, respectively, of a golf club head 1 according to an embodiment.

Figure 1B:
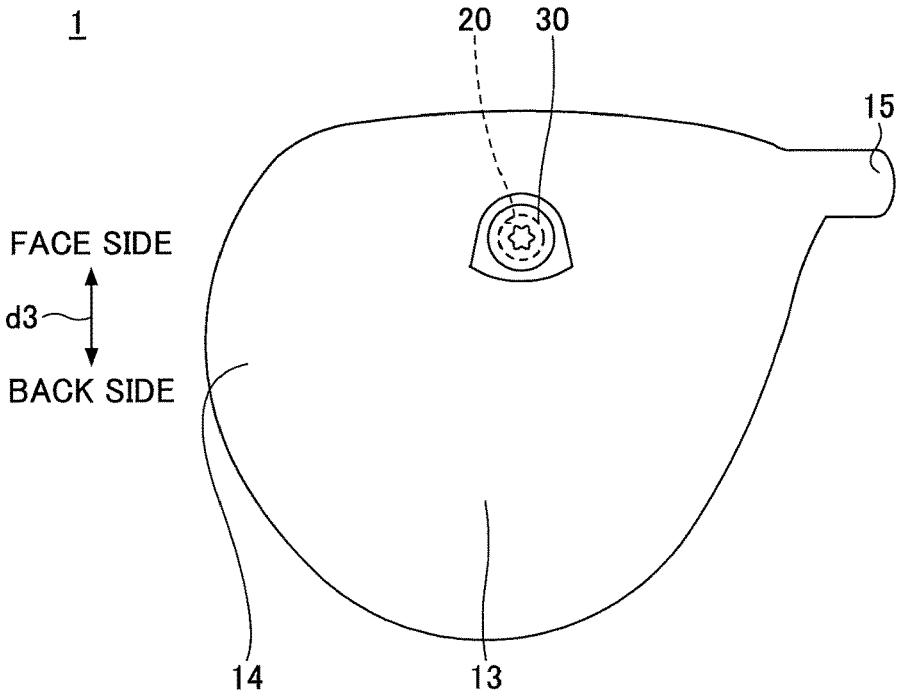
Figure 1C:
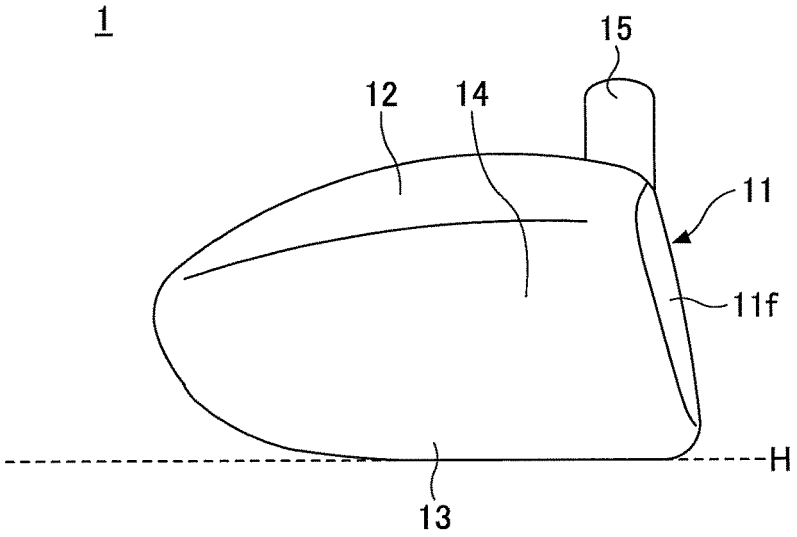
Figure 1D:
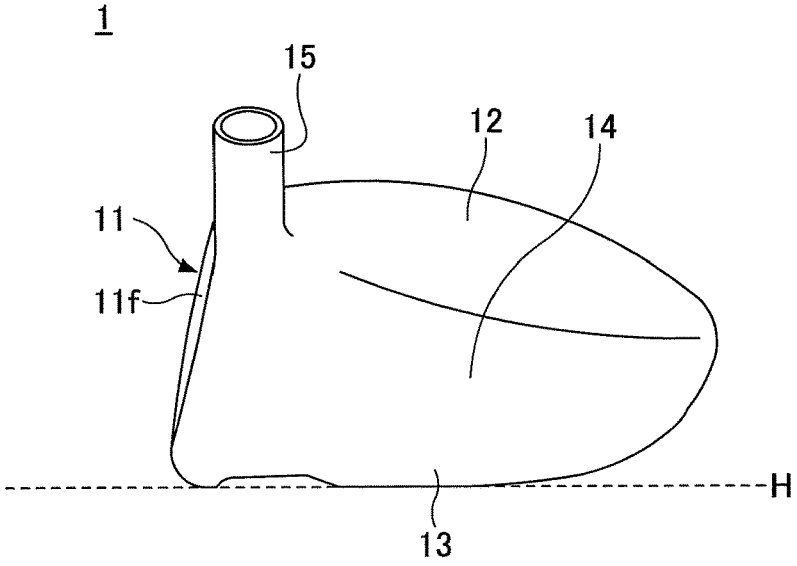

The front elevational view of FIG. 1A is a view taken from the side of a face surface 11*f* of the golf club head 1 (that is, looking at the face surface 11*f*), depicting the golf club head 1 resting (soled) on a horizontal plane H (corresponding to a ground plane) at a reference lie angle θ and a reference loft angle (not depicted). In FIG. 1A, the central axis of the bore of a hosel 15 is indicated by the dashed line J. In FIGS. 1A and 1B, the double-headed arrow d1 indicates the "toe-heel" (left-right) direction, namely, the direction from the toe side to the heel side or the direction from the heel side to the toe side, of the golf club head 1, the double-headed arrow d2 indicates the "top-sole" (up-down) direction, namely, the direction from the top side to the sole side or the direction from the sole side to the top side, of the golf club head 1, and the double-headed arrow d3 indicates the "face-back" (front-rear) direction, namely, the direction from the face side to the back side or the direction from the back side to the face side, of the golf club head 1.

The golf club head 1 depicted in FIGS. 1A through 1D is a wood-type golf club head such as a driver club head, but may also be a hybrid club head or a fairway wood club head. The golf club head 1 may be made using a metal material such as a titanium alloy, titanium, stainless steel, or an aluminum alloy. Multiple parts may be joined and assembled into the golf club head 1. The golf club head 1 is described in more detail below.

The golf club head 1 is a hollow structure that includes a face 11, a crown 12, a sole 13, a sidewall 14, and the hosel 15. An internal surface of the hollow structure may be referred to as "head internal surface" and an external surface of the hollow structure may be referred to as "head external surface."

The face 11 defines a front portion of the golf club head 1, and includes the face surface 11*f*, which defines a ball-striking surface between the crown 12 and the sole 13 in the top-sole direction. The face 11 has a predetermined thickness. The face surface 11*f* forms an external surface of the face 11. The crown 12 defines a top portion of the golf club head 1. The sole 13 defines a bottom portion of the golf club head 1. The sidewall 14 extends between the crown 12 and the sole 13 to define a curved periphery of the golf club head 1 that is continuous with the face surface 11*f*. The hosel 15 receives a shaft.

An attachment part 20 (weight port) configured to receive an attachment member 30 (weight) for head weight adjustment is provided in the sole 13. To prevent the attachment member 30 from projecting from an external surface of the sole 13 when the attachment member 30 is attached to the attachment part 20, it is preferable to provide a recess around the attachment part 20 in the sole 13.

FIG. 1B illustrates the golf club head 1 in which the attachment member 30 is detachably attached to the attachment part 20. The attachment member 30 is detachable from and reattachable to the attachment part 20. The attachment member 30 of a desired weight may be attached on an as-needed basis. The position of the center of gravity of the golf club head 1 can be adjusted by weight adjustment using the attachment member 30.

Figure 2A:
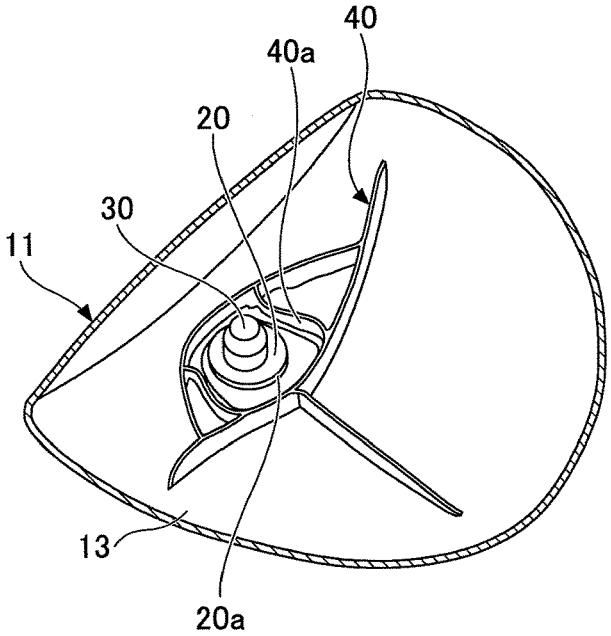
FIGS. 2A through 2D are cross-sectional views of the golf club head, illustrating the head internal surface of the golf club head.
Figure 2B:
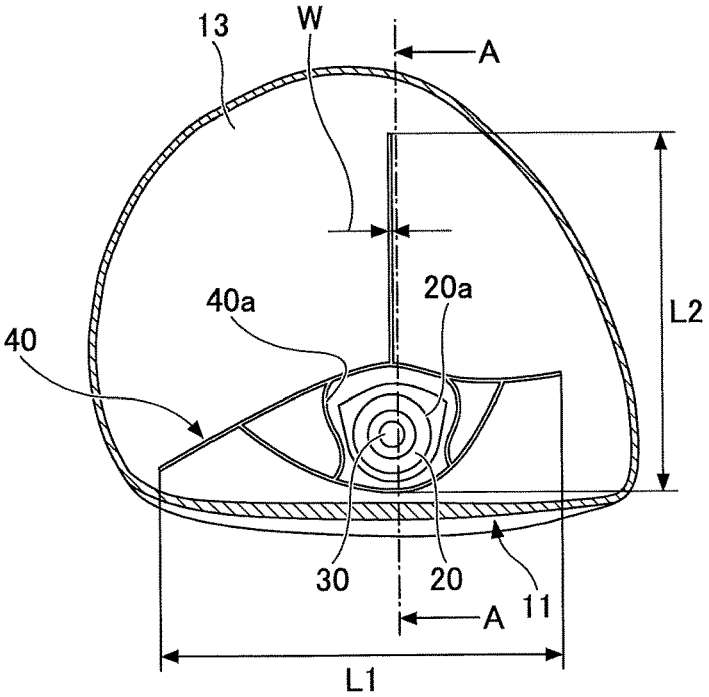
Figure 2C:
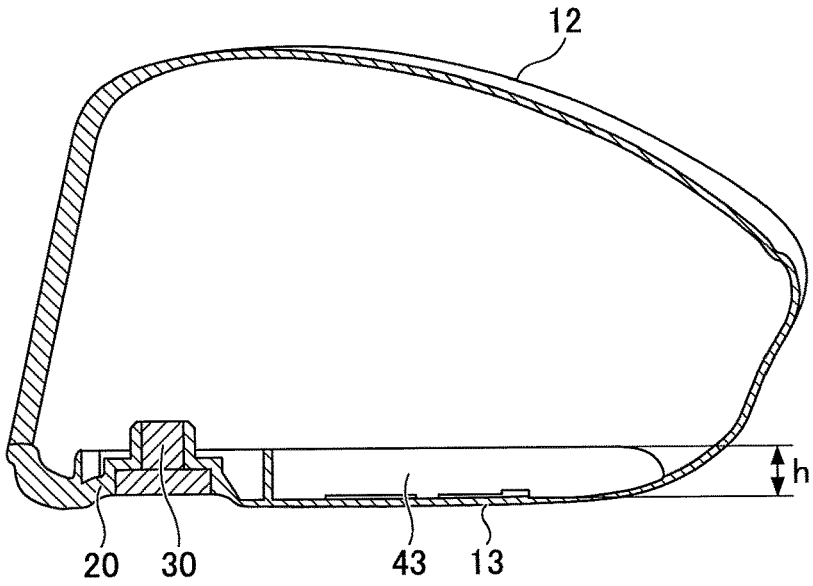
Figure 2D:
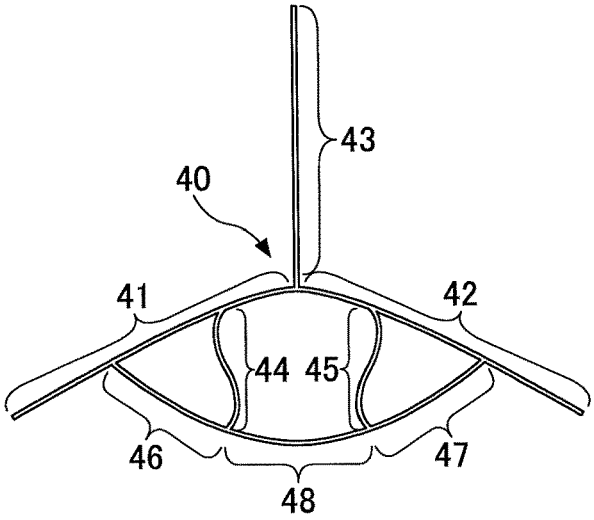

FIGS. 2A through 2D illustrate the head internal surface of the golf club head 1. FIGS. 2A and 2B are transverse cross-sectional views of the golf club head 1, looking at the sole 13 from the top side. FIG. 2C is a vertical cross-sectional view of the golf club head 1, taken along the line A-A of FIG. 2B. A rib 40 in FIG. 2B is taken out and depicted in FIG. 2D.

Referring to FIGS. 2A through 2D, the rib 40 is formed on the head internal surface (the internal surface of the sole 13) of the golf club head 1. The rib 40 includes a first rib 41, a second rib 42, a third rib 43, a fourth rib 44, a fifth rib 45, a sixth rib 46, a seventh rib 47, and an eighth rib 48.

The first rib 41, the second rib 42, and the third rib 43 are connected at a single point (hereinafter, "connecting point") on the back side of the center of the attachment part 20.

The first rib 41 extends from the connecting point toward the toe. The second rib 42 extends from the connecting point toward the heel. The third rib 43 extends from the connecting point toward the back. The first rib 41 may be rectilinear, curved, or a mixture of rectilinear and curved portions. The same is the case with the second rib 42 and the third rib 43.

The fourth rib 44 has a first end connected to the first rib 41 at one point, and extends toward the face 11. The fifth rib 45 has a first end connected to the second rib 42 at one point, and extends toward the face 11. The sixth rib 46 has a first end connected to the first rib 41 at one point on the toe side of the first end of the fourth rib 44, and has a second end connected to a second end of the fourth rib 44.

The seventh rib 47 has a first end connected to the second rib 42 at one point on the heel side of the first end of the fifth rib 45, and has a second end connected to a second end of the fifth rib 45. The eighth rib 48 connects (extends between) the point of connection of the second end of the fourth rib 44 and the second end of the sixth rib 46 and the point of connection of the second end of the fifth rib 45 and the second end of the seventh rib 47.

Part of the first rib 41, part of the second rib 42, the fourth rib 44, the fifth rib 45, and the eighth rib 48 in combination circularly extend to have an annular shape to wholly surround the attachment part 20. The part of the first rib 41, the part of the second rib 42, the fourth rib 44, the fifth rib 45, and the eighth rib 48 are spaced apart from and out of contact with the attachment part 20. The interval (distance) between an outer wall face 20*a* of the attachment part 20 and an inner wall face 40*a* of the part of the first rib 41, the part of the second rib 42, the fourth rib 44, the fifth rib 45, and the eighth rib 48 is, for example, 1 mm or more.

A width W of each of the first through eighth ribs 41 through 48 is, for example, 0.2 mm or more and 3 mm or less. A maximum height h of the rib 40 is, for example, 0.5 mm or more and 20 mm or less. A length L1 of the rib 40 in the toe-heel direction is, for example, 30 mm or more and 120 mm or less. A length L2 of the rib 40 in the face-back direction is, for example, 30 mm or more and 120 mm or less.

Thus, the rib 40 includes a first portion surrounding the attachment part 20 (part of the first rib 41, part of the second rib 42, the fourth rib 44, the fifth rib 45, and the eighth rib 48) and a second portion extending from the first portion in a direction away from the attachment part 20 (part of the first rib 41, part of the second rib 42, the third rib 43, the sixth rib 46, and the seventh rib 47).

Figure 3:
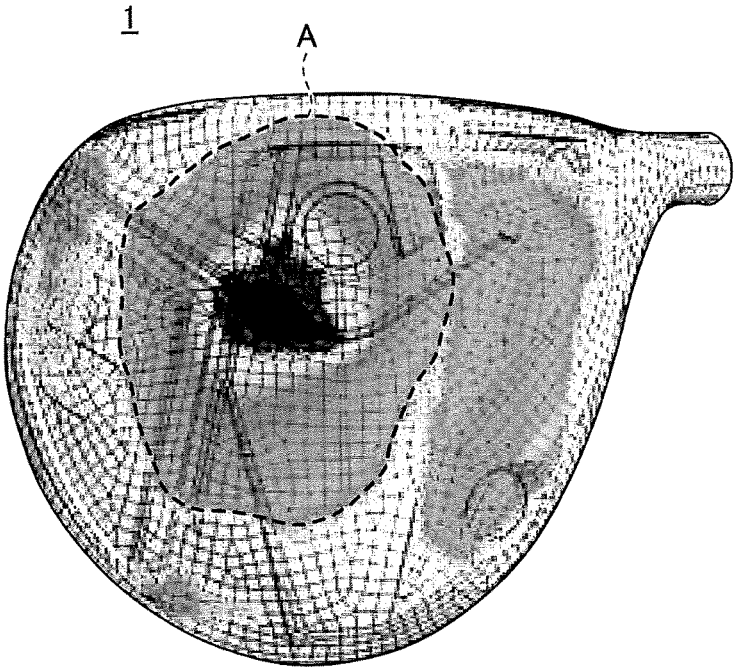
FIG. 3 is a diagram for illustrating the first-order vibration mode of the golf club head in a sole thereof.

FIG. 3 is a diagram for illustrating the first-order vibration mode of the golf club head 1 in the sole 13. In FIG. 3, a darker gray scale area indicates greater amplitude of the first-order vibration mode. The darkest gray scale area (area close to black) is the antinode of the first-order vibration mode, where the amplitude maximizes. The position of the antinode of the first-order vibration mode in the sole 13 may be determined by modal analysis using a computer or eigenvalue analysis using the finite element method (FEM).

When the attachment member 30 is attached to the attachment part 20, the sole 13 is heaviest in a part near the attachment member 30. Therefore, as illustrated in FIG. 3, the sole 13 vibrates most significantly in a part near the attachment member 30, which is the position of the antinode of the first-order vibration mode. This vibration is not preferable for the impact sound. Therefore, in the golf club head 1, it is effective to reduce vibrations in a part near the attachment member 30 to improve the impact sound.

Therefore, according to the golf club head 1, the rib 40 surrounding the attachment part 20 is provided to effectively reduce vibrations in a part near the attachment member 30. To more effectively reduce vibrations of the golf club head 1 generated at the time of striking a ball, the rib 40 preferably includes a portion that extends beyond a vibration region of the first-order vibration mode.

Here, a vibration region of the first-order vibration mode is a combination of the darkest gray scale area (the position of the antinode of the first-order vibration mode) and its surrounding slightly lighter gray scale area. In FIG. 3, the region delineated by the dashed line A is a vibration region of the first-order vibration mode. In the rib 40, the portion that extends beyond a vibration region of the first-order vibration mode is the first rib 41, the second rib 42, and the third rib 43.

Thus, by providing the rib 40 that surrounds the attachment part 20, which is near the position of the antinode of the first-order vibration mode in the sole 13, it is possible to effectively reduce vibrations of the golf club head 1 generated at the time of striking a ball and to improve the impact sound of the golf club head 1.

Furthermore, by spacing the rib 40 apart from the attachment part 20 and providing the rib 40 with a portion that extends in a direction away from the attachment part 20 beyond a vibration region of the first-order vibration mode, it is possible to more effectively reduce vibrations of the golf club head 1 generated at the time of striking a ball and to further increase the impact sound improving effect.

Next, variations of the above-described embodiments are described. The variations illustrate ribs having different shapes. In the following description of the variations, a description of the same elements or components as those of the above-described embodiments may be omitted.

[First Variation]

Figure 4:
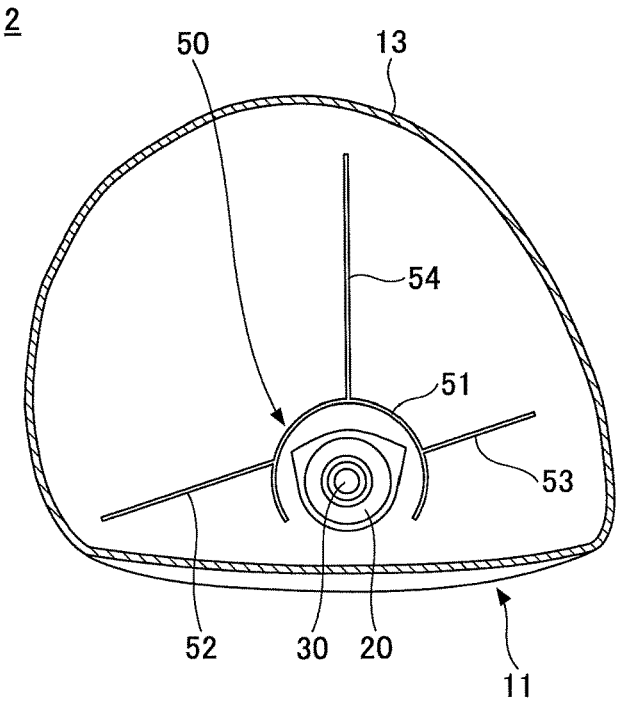
FIG. 4 is a cross-sectional view of a golf club head, illustrating the head internal surface of the golf club head, according to a first variation of the embodiment.

FIG. 4 is a transverse cross-sectional view of a golf club head 2 according to a first variation, looking at the sole 13 from the top side, illustrating the head internal surface of the golf club head 2. Referring to FIG. 4, the golf club head 2 is different from the golf club head 1 (FIGS. 2A through 2D) in that the rib 40 is replaced with a rib 50.

The rib 50 includes a first rib 51, a second rib 52, a third rib 53, and a fourth rib 54.

The first rib 51 extends to partially surround the attachment part 20. The first rib 51 is not provided on the face 11 side of the attachment part 20. The first rib 51 is spaced apart from and out of contact with the attachment part 20. The rib 50 includes a portion that extends to partially surround the attachment part 20 to make it possible to effectively reduce vibrations of the golf club head 1 generated at the time of striking a ball.

In the specification, "at least partially surrounding the attachment part" includes a configuration where a rib wholly (completely) surrounds the attachment part and a configuration where a rib partially surrounds the attachment part (that is, a rib extends along part of the periphery of the attachment part). Furthermore, "partially surrounding the attachment part" refers to a configuration where the center of the attachment part is within a closed area formed by connecting adjacent ends of one or more ribs placed along the periphery of the attachment part by one or more virtual straight lines.

The second rib 52 has a first end connected to the first rib 51 at one point on its toe side, and extends to have a second end facing toward the toe. The third rib 53 has a first end connected to the first rib 51 at one point on its heel side, and extends to have a second end facing toward the heel. The fourth rib 54 has a first end connected to the first rib 51 at one point on its back side, and extends to have a second end facing toward the back. The second rib 52 may be rectilinear, curved, or a mixture of rectilinear and curved portions. The same is the case with the third rib 53 and the fourth rib 54.

The width of each of the first through fourth ribs 51 through 54 may be equal or approximately equal to the width W of the above-described embodiment. The length of the rib 50 in the toe-heel direction and the length of the rib 50 in the face-back direction may be equal or approximately equal to L1 and L2, respectively, of the above-described embodiment.

Thus, the rib 50 includes the first rib 51 that partially surrounds the attachment part 20, and the second rib 52, the third rib 53, and the fourth rib 54 that extend from the first rib 51 in a direction away from the attachment part 20.

The same as in the above-describe embodiment, the rib 50 preferably includes a portion that extends beyond a vibration region of the first-order vibration mode. In the rib 50, the portion that extends beyond a vibration region of the first-order vibration mode is the second rib 52, the third rib 53, and the fourth rib 54.

[Second Variation]

Figure 5:
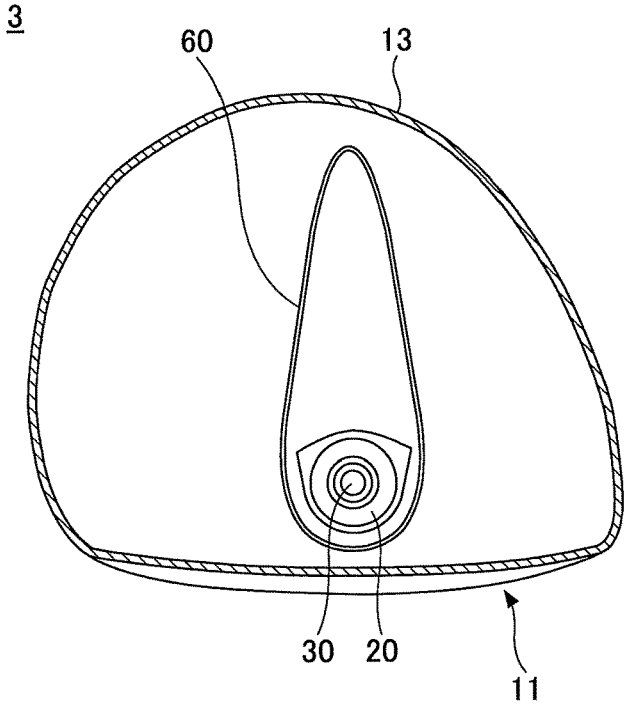
FIG. 5 is a cross-sectional view of a golf club head, illustrating the head internal surface of the golf club head, according to a second variation of the embodiment.

FIG. 5 is a transverse cross-sectional view of a golf club head 3 according to a second variation, looking at the sole 13 from the top side, illustrating the head internal surface of the golf club head 3. Referring to FIG. 5, the golf club head 3 is different from the golf club head 1 (FIGS. 2A through 2D) in that the rib 40 is replaced with a rib 60.

The rib 60 is a single annular rib elongated in the face-back direction, and wholly surrounds the attachment part 20. The rib 60 may have any outer shape such as the shape of an ellipse, a teardrop, a polygon, or a rounded polygon. The rib 60 is spaced apart from and out of contact with the attachment part 20. The rib 60 includes a portion that extends to surround the attachment part 20 to make it possible to effectively reduce vibrations of the golf club head 3 generated at the time of striking a ball.

The rib 60 may be formed of rectilinear portions alone, curved portions alone, or a mixture of rectilinear and curved portions.

The width of the rib 60 may be equal or approximately equal to the width W of the above-described embodiment. The length of the rib 60 in the toe-heel direction may be set to such an appropriate length as to make it possible for the rib 60 to surround the attachment part 20 with a gap between the rib 60 and the attachment part 20. The length of the rib 60 in the face-back direction may be equal or approximately equal to L2 of the above-described embodiment.

The same as in the above-describe embodiment, the rib 60 preferably includes a portion that extends beyond a vibration region of the first-order vibration mode. In the rib 60, the portion that extends beyond a vibration region of the first-order vibration mode is a portion extending on the back side of the attachment part 20.

[Third Variation]

Figure 6:
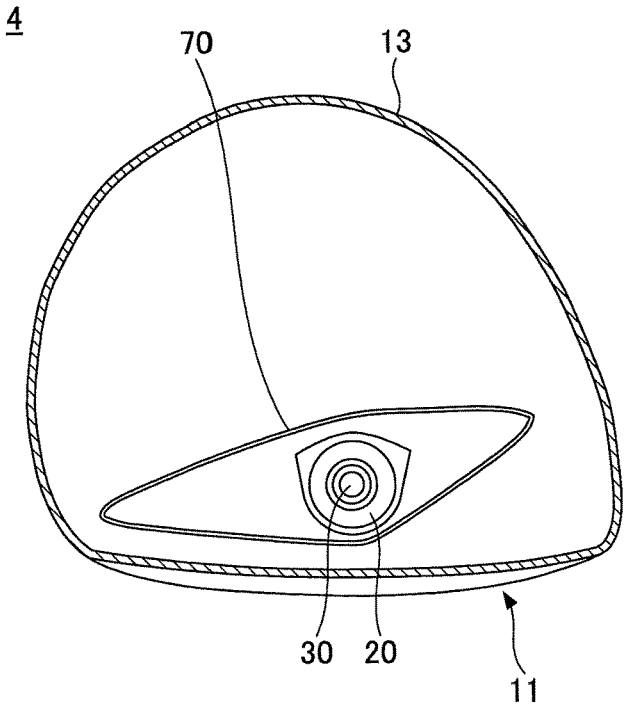
FIG. 6 is a cross-sectional view of a golf club head, illustrating the head internal surface of the golf club head, according to a third variation of the embodiment.

FIG. 6 is a transverse cross-sectional view of a golf club head 4 according to a third variation, looking at the sole 13 from the top side, illustrating the head internal surface of the golf club head 4. Referring to FIG. 6, the golf club head 4 is different from the golf club head 1 (FIGS. 2A through 2D) in that the rib 40 is replaced with a rib 70.

The rib 70 is a single elongated annular rib wholly surrounding the attachment part 20, including a first portion and a second portion that extend from the neighborhood of the attachment part 20 toward the toe and the heel, respectively. The rib 70 may have any outer shape such as the shape of an ellipse, a teardrop, a polygon, or a rounded polygon. The rib 70 is spaced apart from and out of contact with the attachment part 20. The rib 70 includes a portion that extends to surround the attachment part 20 to make it possible to effectively reduce vibrations of the golf club head 4 generated at the time of striking a ball.

The rib 70 may be formed of rectilinear portions alone, curved portions alone, or a mixture of rectilinear and curved portions.

The width of the rib 70 may be equal or approximately equal to the width W of the above-described embodiment. The length of the rib 70 in the toe-heel direction may be equal or approximately equal to L1 of the above-described embodiment. The length of the rib 70 in the face-back direction may be set to such an appropriate length as to make it possible for the rib 70 to surround the attachment part 20 with a gap between the rib 70 and the attachment part 20.

The same as in the above-describe embodiment, the rib 70 preferably includes a portion that extends beyond a vibration region of the first-order vibration mode. In the rib 70, the portion that extends beyond a vibration region of the first-order vibration mode is the first portion and the second portion that extend from the neighborhood of the attachment part 20 toward the toe and the heel, respectively.

[Fourth Variation]

Figure 7:
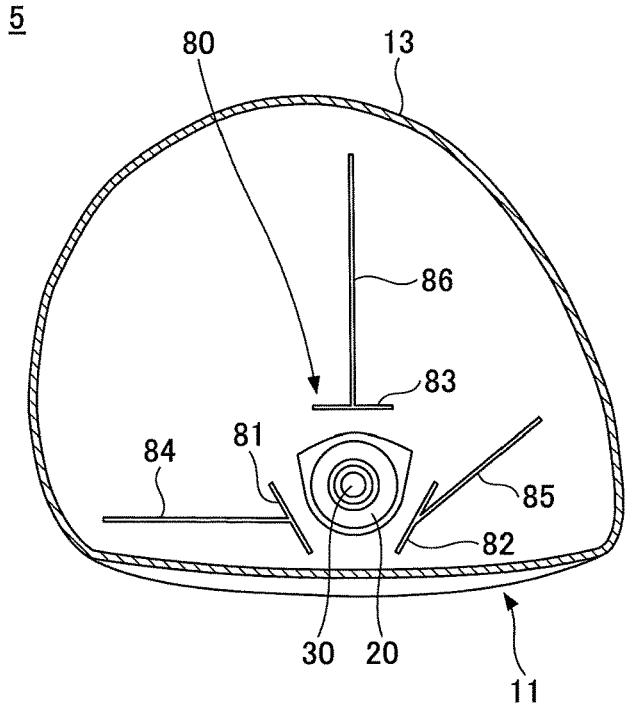
FIG. 7 is a cross-sectional view of a golf club head, illustrating the head internal surface of the golf club head, according to a fourth variation of the embodiment.

FIG. 7 is a transverse cross-sectional view of a golf club head 5 according to a fourth variation, looking at the sole 13 from the top side, illustrating the head internal surface of the golf club head 5. Referring to FIG. 7, the golf club head 5 is different from the golf club head 1 (FIGS. 2A through 2D) in that the rib 40 is replaced with a rib 80.

The rib 80 includes a first rib 81, a second rib 82, a third rib 83, a fourth rib 84, a fifth rib 85, and a sixth rib 86.

The first rib 81, the second rib 82, and the third rib 83 are placed at predetermined intervals to partially surround the attachment part 20. Each of the first rib 81, the second rib 82, and the third rib 83 may be rectilinear, curved, or a mixture of rectilinear and curved portions. The first rib 81, the second rib 82, and the third rib 83 are spaced apart from and out of contact with the attachment part 20. The rib 80 includes a portion that extends to partially surround the attachment part 20 to make it possible to effectively reduce vibrations of the golf club head 5 generated at the time of striking a ball.

The fourth rib 84 has a first end connected to the first rib 81 at one point, and extends to have a second end facing toward the toe. The fifth rib 85 has a first end connected to the second rib 82 at one point, and extends to have a second end facing toward the heel. The sixth rib 86 has a first end connected to the third rib 83 at one point, and extends to have a second end facing toward the back. Each of the fourth rib 84, the fifth rib 85, and the sixth rib 86 may be rectilinear, curved, or a mixture of rectilinear and curved portions.

The width of each of the first through sixth ribs 81 through 86 may be equal or approximately equal to the width W of the above-described embodiment. The length of the rib 80 in the toe-heel direction and the length of the rib 80 in the face-back direction may be equal or approximately equal to L1 and L2, respectively, of the above-described embodiment.

Thus, the rib 80 includes the first rib 81, the second rib 82, and the third rib 83 that partially surround the attachment part 20, and the fourth rib 84, the fifth rib 85, and the sixth rib 86 that extend from the first rib 81, the second rib 82, and the third rib 83, respectively, in a direction away from the attachment part 20.

The same as in the above-describe embodiment, the rib 80 preferably includes a portion that extends beyond a vibration region of the first-order vibration mode. In the rib 80, the portion that extends beyond a vibration region of the first-order vibration mode is the fourth rib 84, the fifth rib 85, and the sixth rib 86.

[Fifth Variation]

Figure 8:
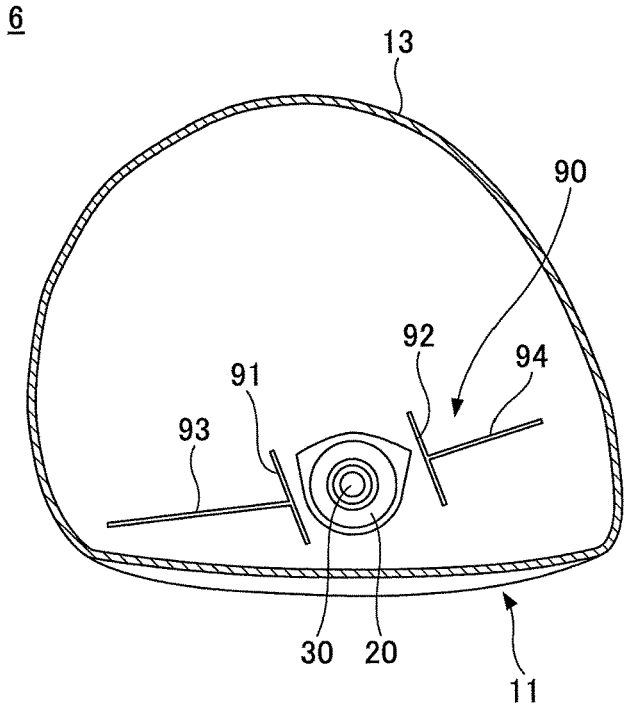
FIG. 8 is a cross-sectional view of a golf club head, illustrating the head internal surface of the golf club head, according to a fifth variation of the embodiment.

FIG. 8 is a transverse cross-sectional view of a golf club head 6 according to a fifth variation, looking at the sole 13 from the top side, illustrating the head internal surface of the golf club head 6. Referring to FIG. 8, the golf club head 6 is different from the golf club head 1 (FIGS. 2A through 2D) in that the rib 40 is replaced with a rib 90.

The rib 90 includes a first rib 91, a second rib 92, a third rib 93, and a fourth rib 94.

The first rib 91 and the second rib 92 are placed at predetermined intervals to partially surround the attachment part 20. Each of the first rib 91 and the second rib 92 may be rectilinear, curved, or a mixture of rectilinear and curved portions. The first rib 91 and the second rib 92 are spaced apart from and out of contact with the attachment part 20. The first rib 91 and the second rib 92 may be parallel to each other. The rib 90 includes a portion that extends to partially surround the attachment part 20 to make it possible to effectively reduce vibrations of the golf club head 6 generated at the time of striking a ball.

The third rib 93 has a first end connected to the first rib 91 at one point, and extends to have a second end facing toward the toe. The fourth rib 94 has a first end connected to the second rib 92 at one point, and extends to have a second end facing toward the heel. Each of the third rib 93 and the fourth rib 94 may be rectilinear, curved, or a mixture of rectilinear and curved portions.

The width of each of the first through fourth ribs 91 through 94 may be equal or approximately equal to the width W of the above-described embodiment. The length of the rib 90 in the toe-heel direction may be equal or approximately equal to L1 of the above-described embodiment. The length of the rib 90 in the face-back direction may be set to such an appropriate length as to make it possible for the rib 90 to partially surround the attachment part 20 with a gap between the rib 90 and the attachment part 20.

Thus, the rib 90 includes the first rib 91 and the second rib 92 that partially surround the attachment part 20, and the third rib 93 and the fourth rib 94 that extend from the first rib 91 and the second rib 92, respectively, in a direction away from the attachment part 20.

The same as in the above-describe embodiment, the rib 90 preferably includes a portion that extends beyond a vibration region of the first-order vibration mode. In the rib 90, the portion that extends beyond a vibration region of the first-order vibration mode is the third rib 93 and the fourth rib 94.

As illustrated in the first through fifth variations, by providing the rib 50, 60, 70, 80 or 90 that at least partially surrounds the attachment part 20 on the sole 13, it is possible to effectively reduce vibrations of a golf club head generated at the time of striking a ball and to improve the impact sound of the golf club head.

Furthermore, by spacing the rib 50, 60, 70, 80 or 90 apart from the attachment part 20 and providing the rib 50, 60, 70, 80 or 90 with a portion that extends in a direction away from the attachment part 20 beyond a vibration region of the first-order vibration mode, it is possible to more effectively reduce vibrations of the golf club head generated at the time of striking a ball and to further increase the impact sound improving effect.

Thus, according to an aspect of the present invention, it is possible to provide a golf club head whose impact sound is improved.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A golf club head comprising:
a face including a ball-striking surface;
a sole defining a bottom of the golf club head;
an attachment member;
an attachment part to which the attachment member is attachable; and
a rib formed on an internal surface of the golf club head, wherein the rib is spaced apart from the attachment part, and
wherein the rib extends so as to wholly surround the attachment part.

2. The golf club head as claimed in claim 1, wherein the rib includes a portion that extends beyond a vibration region of a first-order vibration mode of the golf club head.

3. The golf club head as claimed in claim 1, wherein the rib includes a first portion that wholly surrounds the attachment part and a second portion that extends from the first portion in a direction away from the attachment part.

4. The golf club head as claimed in claim 1, wherein the rib includes a plurality of ribs.

5. The golf club head as claimed in claim 1, wherein the rib is shaped as any one of an ellipse, a teardrop and a polygon.

6. A golf club head comprising:
a face including a ball-striking surface;
a sole defining a bottom of the golf club head;
an attachment member;
an attachment part to which the attachment member is attachable; and
a rib formed on an internal surface of the golf club head, the rib at least partially surrounding the attachment part, wherein the rib includes a first rib and a second rib that are arranged so as to be parallel to each other with a predetermined space between the first and second ribs.

* * * * *